US007296775B2

(12) United States Patent
Mayer

(10) Patent No.: US 7,296,775 B2
(45) Date of Patent: Nov. 20, 2007

(54) CONTINUOUSLY ROTATABLE ELECTRONIC-DEVICE ORGANIZER

(76) Inventor: Peter L. Mayer, 4053 Higel Ave., Sarasota, FL (US) 34242

( * ) Notice: Subject to any disclaimer, the term of this patent is extended or adjusted under 35 U.S.C. 154(b) by 352 days.

(21) Appl. No.: 11/189,258

(22) Filed: Jul. 26, 2005

(65) Prior Publication Data

US 2007/0026694 A1 Feb. 1, 2007

(51) Int. Cl.
*A97B 91/00* (2006.01)

(52) U.S. Cl. ..... 248/349.1; 211/163; 248/918

(58) Field of Classification Search ..... 248/349.1, 248/918, 521; 211/163, 144, 131.1; 439/13, 439/21

See application file for complete search history.

(56) References Cited

U.S. PATENT DOCUMENTS

| | | | | |
|---|---|---|---|---|
| 2,890,088 A | | 6/1959 | Lepry et al. | |
| 3,652,972 A | | 3/1972 | Krelder | |
| 3,794,952 A | | 2/1974 | Dowis | |
| 4,119,834 A | | 10/1978 | Losch | |
| 4,237,796 A | | 12/1980 | Gordan et al. | |
| 4,431,238 A | | 2/1984 | Evans | |
| 5,243,434 A | * | 9/1993 | Nodama | 348/827 |
| 5,421,271 A | | 6/1995 | Sui | |
| 5,494,347 A | | 2/1996 | Poortvliet | |
| 5,535,684 A | | 7/1996 | John | |
| 5,765,796 A | | 6/1998 | Lanis | |
| 6,231,020 B1 | * | 5/2001 | Willson | 248/349.1 |
| 6,273,531 B1 | | 8/2001 | Scheffer | |
| 6,370,020 B1 | * | 4/2002 | Toukairin | 361/681 |
| 6,536,362 B2 | | 3/2003 | Clarke | |
| 6,953,179 B2 | * | 10/2005 | Lai | 248/522 |

FOREIGN PATENT DOCUMENTS

WO WO 92/06618 4/1992

OTHER PUBLICATIONS

Designer's Dream Desk For 1-Thing, web site, http://news.bbc.co.uk/1/hi/technology/3141955.stm.

Lazy Susan Computer Desk, web site, http://www.charm.net/~jriley/lazys1.html.

* cited by examiner

*Primary Examiner*—Ramon O Ramirez
(74) *Attorney, Agent, or Firm*—Fleit Kain Gibbons Gutman Bongini & Bianco; Paul D. Bianco; Martin Fleit

(57) ABSTRACT

The present invention provides a rotatable storage device including a rotatable platform configured for storing and allowing ease of access to electronic devices such as, printers, facsimile machines, computers, scanners, and others. The rotatable platform include high and low voltage receptacle for connection to the electronic devices. The high and low voltage receptacles provide power, as well as data and voice communication to the electronic devices. The receptacles are connected to a rotatable connector allowing the rotatable platform and receptacle to be rotated in unison without the twisting or tangling of the power and connecting wires. The rotatable connector can take the form of sliprings, brushes, mercury rotatable connectors, or other known devises.

18 Claims, 7 Drawing Sheets

CONTINUOUSLY ROTATABLE ELECTRONIC-DEVICE ORGANIZER

FIELD OF THE INVENTION

The invention relates generally to storing and organizing electronic devices and more specifically to a device that holds and supplies power and data communication to a plurality of common desk-top items while allowing continuous rotatable access to each item.

BACKGROUND OF THE INVENTION

Technology has provided us with many useful tools for making communication and basic office functions efficient, easy, and of higher quality. Some of these devices include computers, computer monitors, printers, scanners, facsimile machines, copiers, cordless telephones, transponders for wireless connectivity, paper shredders, surge protectors, and others. However, spatially arranging all of these useful devices consumes an inordinate amount of desk-top real-estate, leaving less and less room to actually accomplish the work which the devices are intended to facilitate.

Additionally, each device must be powered, which requires a separate power-carrying cable running from a power source to each device. Furthermore, many of the devices also require interconnectivity to at least one other device, the internet, a phone line, all three, or others. The aggregation of devices on a desk brings with it a multitude of cables strung throughout and consuming further work-space area. The cables are not only unattractive; they also interfere with the workspace and become a nuisance.

Storing the devices on the floor is an alternative to utilizing valuable desk space. However, storing devices on the floor suffers from the disadvantages of making the devices difficult or inconvenient to reach, easy to damage by kicking, stepping on, or otherwise, and also consuming valuable floor space.

SUMMARY OF THE INVENTION

The present invention provides a rotatable storage device including a continuously rotatable platform configured for storing and allowing ease of access to electronic devices such as printers, fax machines, computers, scanners, and others. The device includes a base member having high and low voltage base connectors. A support platform is rotatably positioned on the base member and includes an acceptor assembly having high and low voltage receptacles. A rotatable connector includes a first connector portion and a second connector portion rotatable with respect to the first connector portion. The rotatable connector further includes high and low voltage connectors, wherein the rotatable connector electrically couples the acceptor assembly high and low voltage receptacles and the high and low voltage base receptacles, such that the acceptor assembly high and low voltage receptacles are rotatable with respect to the high and low voltage base receptacles as the support platform is rotated with respect to the base member.

The device can further include a first column affixed to and extending from the support platform. A second supporting platform can be rotatably affixed to the first column, such that the second support platform is rotatable with respect to first support platform. The second platform can include a second column affixed to and extending there from. The first and second column can each include high and low voltage receptacles, where a first rotatable connector operably connects the high and low voltage receptacles of the first column to the base high and low voltage connectors. A second rotatable connector operably connects the high and low voltage receptacles of the second column to the high and low voltage receptacle of the first column.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein:

FIG. 9 depicts a multi-platform assembly including sectioned platforms; and

DETAILED DESCRIPTION OF THE INVENTION

The present invention provides a rotatable storage device including a rotatable platform configured for storing and allowing ease of access to electronic devices such as, printers, facsimile machines, computers, scanners, and others. The rotatable platform includes high and low voltage receptacle for connection to the electronic devices. The high and low voltage receptacles provide power, as well as data and voice communication to the electronic devices. The receptacles are connected to a rotatable connector allowing the rotatable platform and receptacle to be rotated in unison without the twisting or tangling of the power and connecting wires. The rotatable connector can take the form of sliprings, brushes, mercury rotatable connectors, or other known devices.

Figure 1:
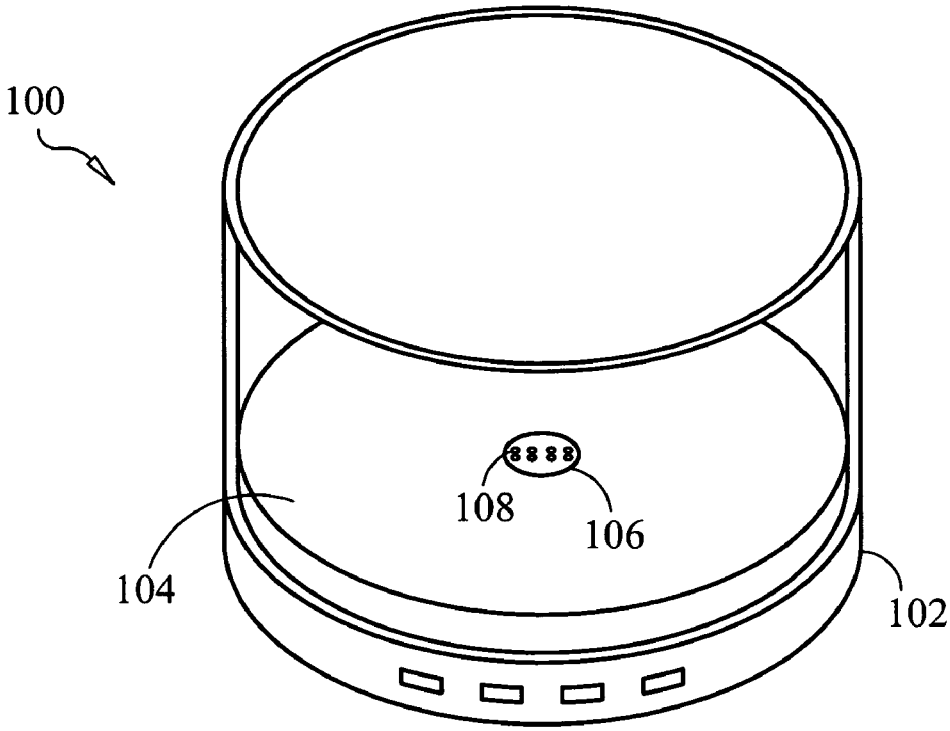
FIG. 1 is a perspective view of the assembly of the present invention.

Referring now to the drawing figures in which like reference designators refer to like elements, there is shown in FIG. 1 an assembly 100 of the present invention. The assembly 100 includes a base section 102 and a rotatable platform 104. An acceptor assembly 106, including a plurality of high and low voltage receptacles 108, is centrally positioned on and connected to the rotatable platform 104, such that the receptacle assembly 106 rotates with the rotatable platform 104. The receptacles 108 are configured for receiving and securing of data cables and power cables for connection to the electronic devices. The base section 102 can further include a surge protector, uninterrupted power supply ("UPS"), or other electronic connector or modifier connected to the acceptor assembly 106.

The rotatable platform 104 can be any shape, but in the embodiment shown, is circular. The rotatable platform 104 may be made of any rigid material, such as plastic, metal, wood, or others.

Figure 2:
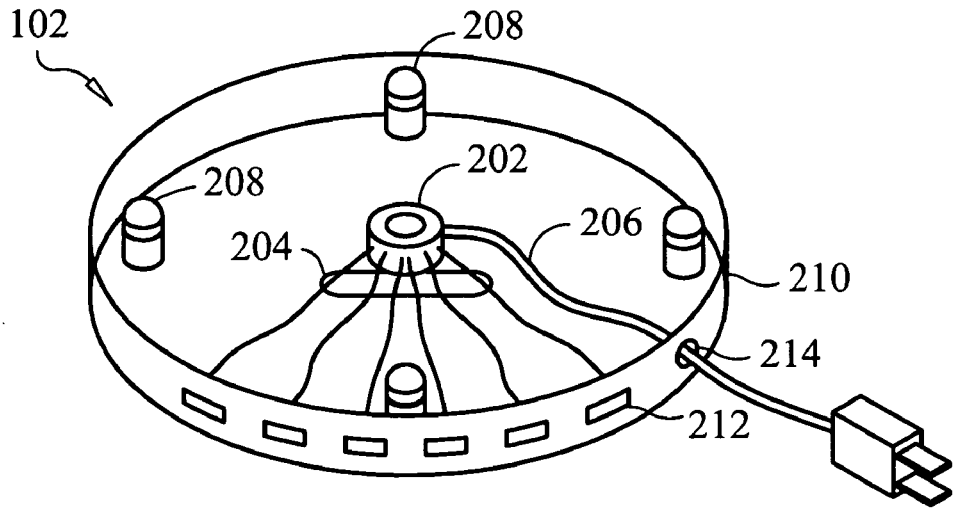
FIG. 2 is a perspective view of the base section of FIG. 1, shown separated from the assembly.

Referring to FIG. 2, the acceptor assembly 106 is operably connected to an acceptor 202 configured for receiving and securing low-voltage cables 204 and a power cable 206. Surrounding the acceptor 202 is a number of rollers 208 for supporting the rotatable platform 104 positioned on the base section 102. The rollers 208 can be wheels, balls, or any other friction-reducing surface or mechanism.

Located along an outside edge 210 of the base section 102 is a plurality of data ports 212. The data ports include low voltage ports, jacks, or connectors, which can include, but are not limited to, one or more of the following: ethernet ports, phone jacks, USB ports, serial ports parallel ports, coaxial cable connectors, and RCA jacks. The ports 212 are coupled to the acceptor 202 allowing electronic devices and services outside the assembly 100 to couple to the assembly 100 and communicate with the electronic devices located on the assembly 100. The devices can include such items as computers, computer monitors, printers, scanners, facsimile machines, copiers, cordless telephones, transponders for wireless connectivity, and others. Services include telephone, cable, internet, intranet, and others.

The cables 204 run from the ports 212 to the acceptor 202 and are able to carry low-voltage data signals between the ports 212 and a connector that couples the base section 102 to the rotatable platform 104 as will be explained below. The cables 204 can be any industry standard or specially made cable for transmitting low-voltage data signals. The term "low-voltage," as used herein, refers to voltages below 110 volts and the term "high-voltage" will refer to voltages that are 110 volts and above. In other words, high-voltage means the standard electrical power and is generally 100-240 $V_{AC}$, 0.15 A and 50-60 Hz. In contrast, low-voltage is generally a DC voltage, and, depending on the device, is typically less than 24 $V_{DC}$.

The power cable 206 is a standard power cord for carrying high-voltage of 110 volts and higher. The outside edge 210 of the base section 102 has an opening 214 where the cable 206 passes through the wall 210. The power cable 206, similar to the data cables 204, passes through the acceptor 202 for connection to the connector (not shown). The base section 102 can further include a spring-loaded recoiler for winding up and keeping portions of the power cord 206 within the base 102. Alternatively, the outer edge 210 of the base section 102 can include a power receptacle, surge protector, or UPS configured for receiving a power cord.

Figure 3:
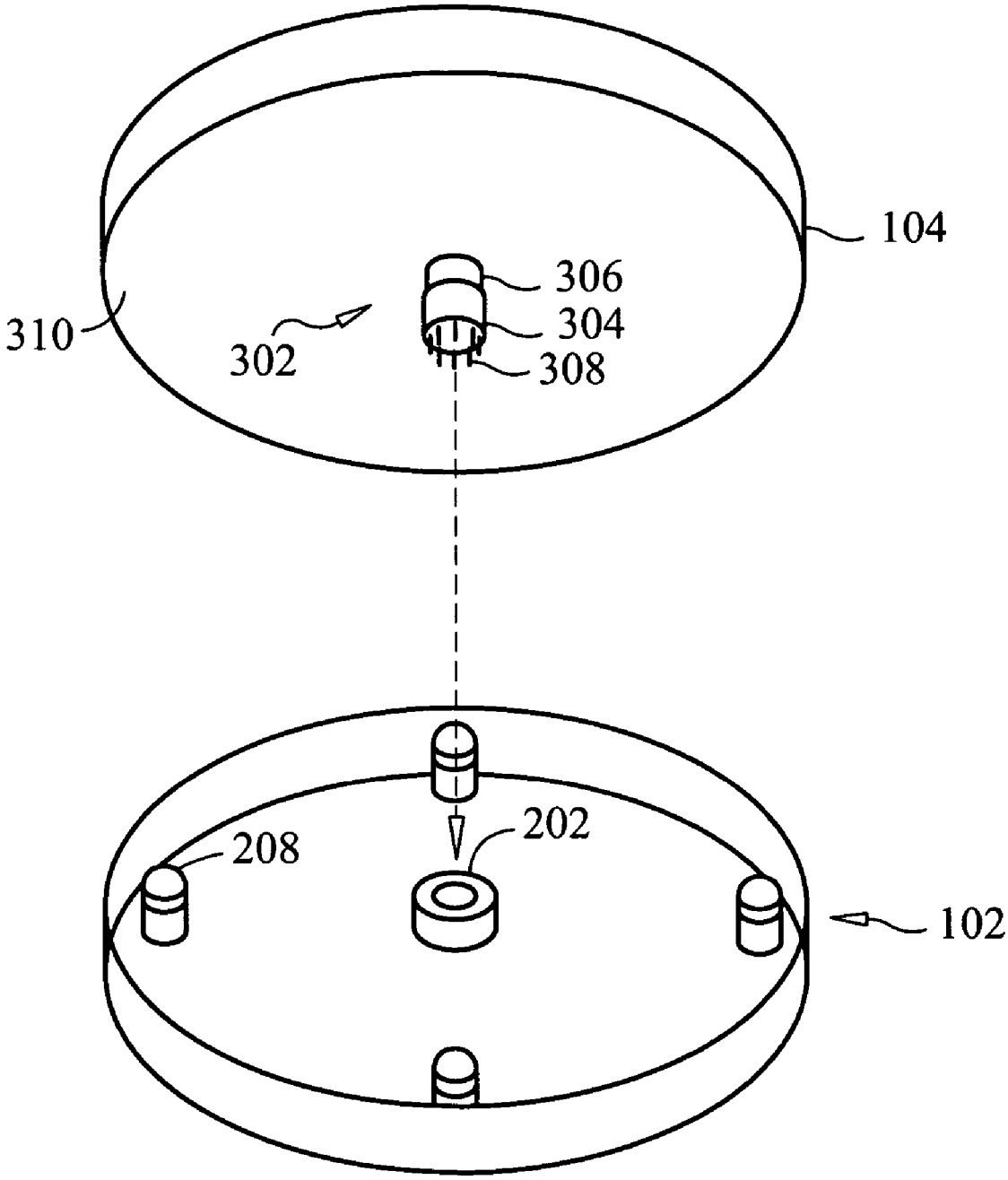
FIG. 3 is a perspective view of the base and rotatable platform of FIG. 1, showing the rotatable platform separated from the base.

Referring now to FIG. 3, the acceptor assembly includes a connector 302 that couples voltage receptacles 108 on the rotatable platform 104 to the acceptor 202. The connector 302 can include two coaxial sections, a first section 304 and a second section 306, that are each rotatable with respect to each other. The connector 302 has a plurality of pins 308 on the first section 304 and a corresponding plurality of pins 312 (not shown) on the second section, opposite the first section 304. Within the connector 302 are conductive pathways that connect each individual pin 308 to a corresponding one of the pins 312 so that each pin is a single isolated pathway to a pin on the other side of the connector 302. The connector 302 further allows the sections 304 and 306 to be rotated any number of times in either of two directions with the sets of corresponding pins remaining electrically coupled to each other throughout all angles of the rotation.

One exemplary connector is connector "830," manufactured by Mercotac, Inc. of Carlsbad Calif. The "830" connector provides eight pins on each section of the rotatable connector's two sections. Within the "830" connector are channels where connector pins are present and conductive mercury within the channel keeps each set of two pins in electrical communication, regardless of rotation of the two sections. The 830 connector provides 6 pathways rated up to 30 amps and 2 pathways rated up to 4 amps. It should be noted that other connectors having fewer or lesser pins or other mechanisms, such as sliprings and brushes, for allowing rotation while keeping uninterrupted electrical communication between sets of pins, may also be used in the present invention.

The connector 302 couples to the acceptor 202. The cables 204 and 206 are terminated at the pins 308 on the first section 304 of the connector 302. Rollers 208 make contact with a bottom side 310 of, and support, the first rotatable platform 104. The rollers 208 provide support so that when the electronic devices are placed on the surfaces, undo strain is not placed on the connector 302. Other methods of providing support so that the rotatable platform 104 can rotate independent of the base may be used and are within the spirit and scope of the invention.

Figure 4:
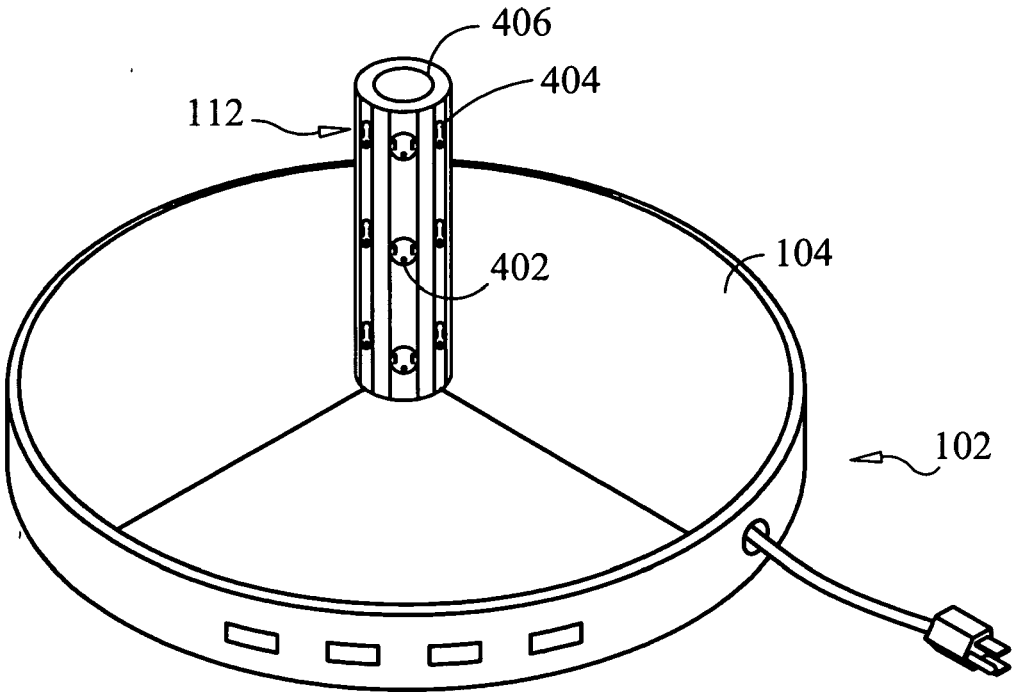
FIG. 4 is a perspective view of the assembly including a center column.

Referring now to FIG. 4, the rotatable platform 104 is shown placed on the base section 102. The acceptor assembly 106 can include a first column 112 centrally positioned on and connected to the rotatable platform 104, such that the first column 112 rotates with the rotatable platform 104. The first column 112 can be a hollow tubular member and includes one or more high-voltage power receptacles 402 and one or more low-voltage receptacles 404.

Figure 5:
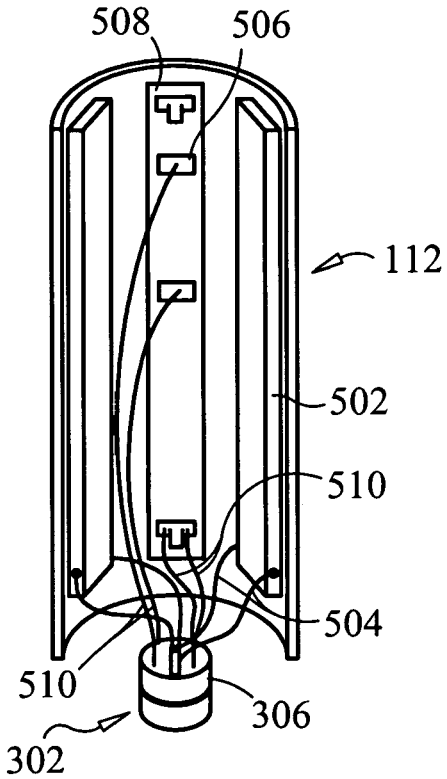
FIG. 5 is a cutaway view of the first column of FIG. 4.

FIG. 5 shows a cutaway view of an exemplary column 112. Provided within the column 112 is at least one high-voltage receptacle for supplying power to electronic devices. In one embodiment of the present invention, a plurality of high-voltage receptacles are provided within one or more power strips 502 secured on an interior of the column 112. Power is supplied to the strip from the second side 306 of the connector 302 by a set of wires 504.

Also provided within the column 112 are one or more low-voltage receptacles 506. The low voltage receptacles 506 can include low voltage jacks, ports, or connectors, including but not limited to, ethernet ports, phone jacks, USB ports, serial ports, parallel ports, coaxial cable connectors, and RCA jacks, among others. The low-voltage receptacles 506 can be provided within a power strip 508, which has one or more types of low-voltage receptacles 506. Each low-voltage receptacle 506 is electrically coupled to the second side 306 of the connector 302 by one or more wires 510. It should be noted that the present invention is not limited to a column or round shape for supporting receptacles and/or supplying high-voltage power or low-voltage signals to electronic items on the same or different platforms. Other shapes, such as boxes or others are contemplated and are within the spirit and scope of the invention. In other embodiments, the receptacles are provided within the item-supporting platforms.

As stated above, the rotatable platform 104 and the first column 112 are mechanically coupled together so that when the rotatable platform 104 is rotated, the column 112 also rotates. The connector 302 allows the wires 504 and 510 to remain stationary relative to the power strips 502 and 508 so that the wires 504 and 510 do not become twisted and pulled away from the power strips 502 and 508.

Figure 6:
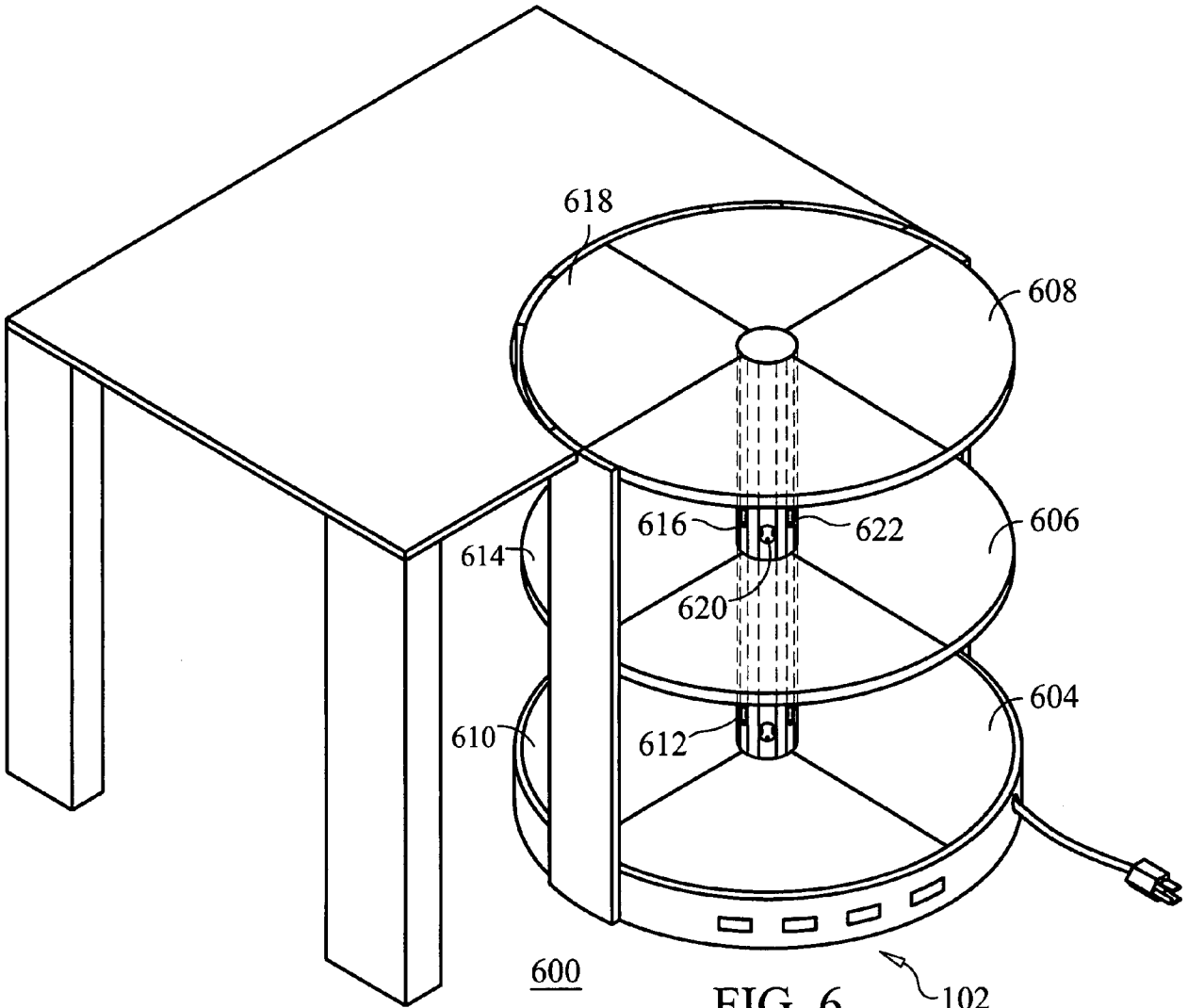
FIG. 6 is a perspective view of a multi-platform assembly.

In another embodiment, the assembly 600 may include a number of tiers. Referring to FIG. 6, the base section 602 can include a first tier 604, a second tier 606, and a third tier 608. The first tier 604 includes a first support platform 610 mechanically coupled to a first column 612. The second tier 606 includes a second support platform 614 mechanically coupled to a second column 616. The first and second columns 612 and 616 can be a hollow tubular member and include one or more high voltage power receptacles 620 and one or more low voltage receptacles 622. The third tier 608 includes a third support platform 618. Each of the platforms 610, 614, 618 is supported by the column portion of the platform below. It should be noted that the second tier 606 and the third tier 608 are not necessary to realize the present invention and that the invention is not limited to any particular number of platforms and, in at least one embodiment, there are more than three tiers.

Figure 7:
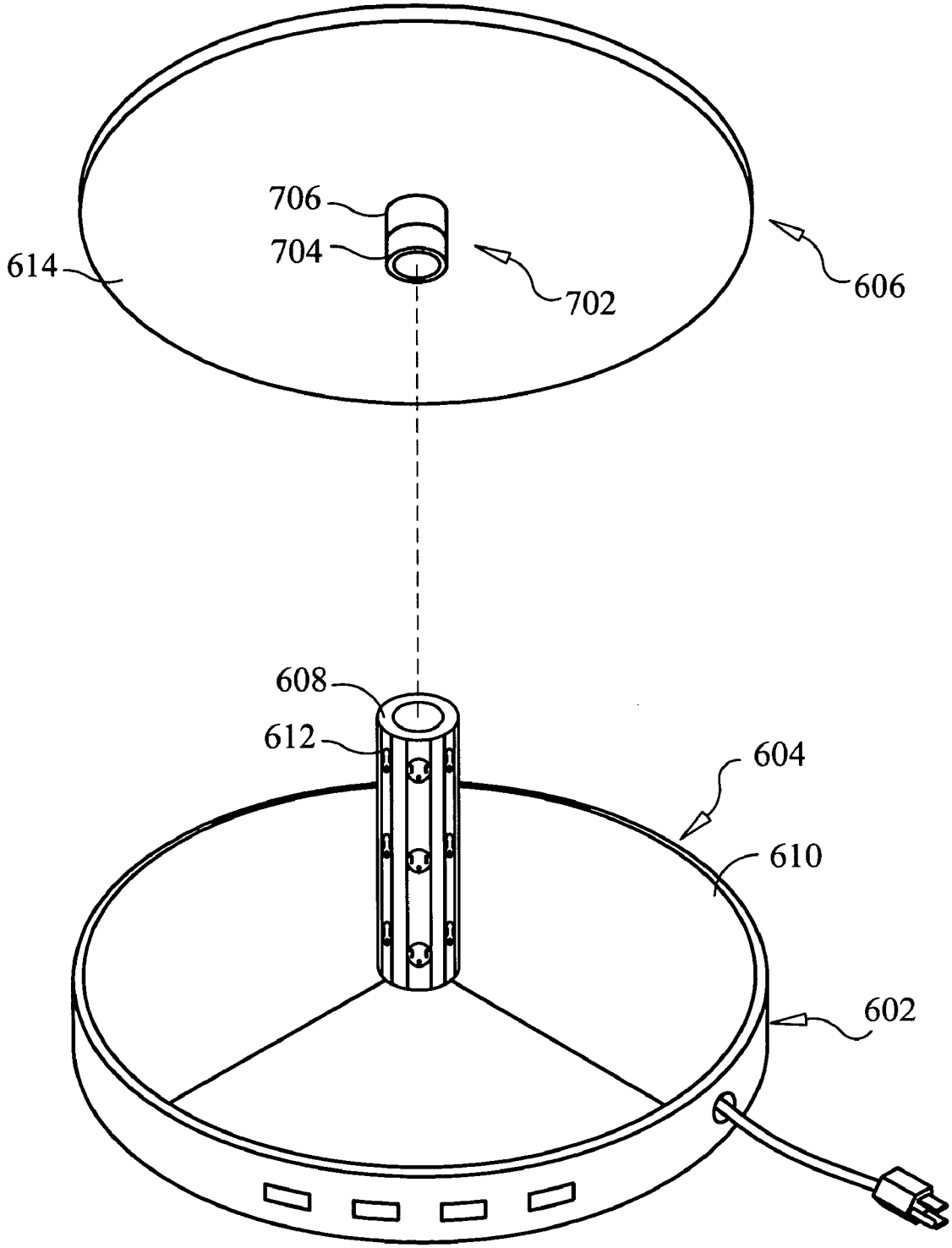
FIG. 7 is a perspective view of the first platform and second platform of FIG. 6, showing the first platform separated from the second platform.

Referring now to FIG. 7, the first platform 610 is substantially similar to the rotatable platform 104 as described above, and coupled to the base section 602 in like manner. The second platform 614 is similar to the first platform 610 and is placed on top of the first platform 610. Protruding from the bottom of the second platform 614 is a second rotatable connector 702 that includes a coaxial first half 704 and second half 706 that rotate relative to one another while maintaining at least one continuous electrical path between the two halves 704 and 706 of the connector 702.

In one embodiment, the second connector 702 is inserted inside the upper portion 608 of the first column 612. In this configuration, the first platform 610 and the second platform 614 can rotate independently of each other. Any number of platforms can be stacked in this manner and the invention is not limited to the number shown in the diagrams.

Referring back to FIG. 6, it is shown that a second column 616 is mechanically coupled to the second platform 614. The second column 616 is similar in structure to the first column 612 as shown in FIG. 5. The second column 616 is provided with one or more high-voltage receptacles 120 and one or more low-voltage receptacles 122. The second connector 702 receives power from the second side 306 of the first connector 308. Both the second side 306 of the first connector 308 and the first side 704 of the second connector 702 are mechanically coupled to the first column 612 so that the second side 306 of the first connector 308 and the first side 704 of the second connector 702 maintain a fixed orientation to each other.

Figure 8:
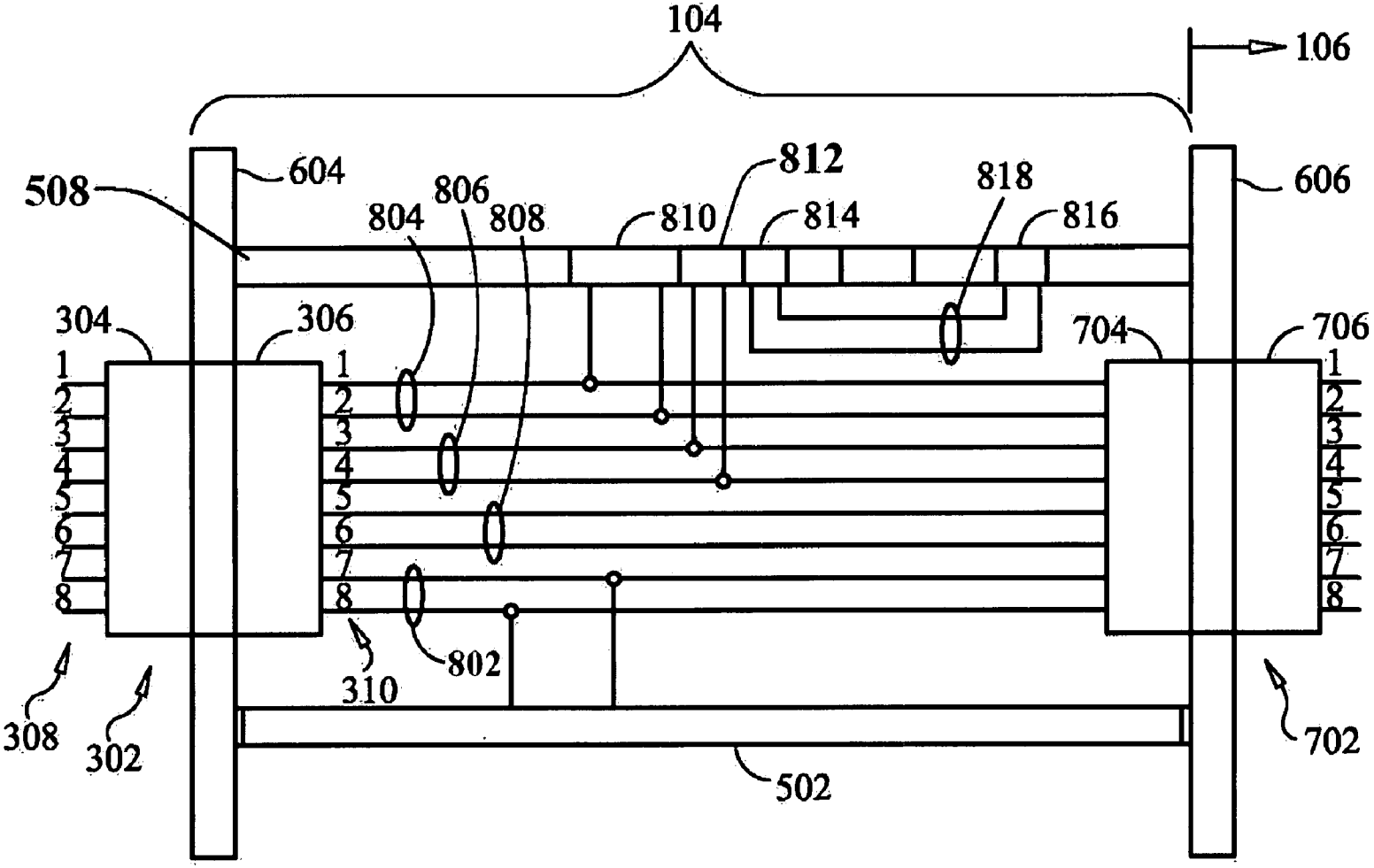
FIG. 8 is a wiring diagram of the assembly of FIG. 6.

FIG. 8 shows an exemplary wiring diagram for exemplary electrical connections between the first platform 604 and the second platform 606. In the diagram, connectors having eight pins are shown for simplicity of illustration. However, connectors having more or less than eight pins can be used with the present invention. In the figure, pins 1 through 8 are provided on the first side 304 of the first connector 302. Pins 1 through 8 are electrically connected to corresponding pins 1 through 8 on the second side 306 of the first connector 302. Wires 802 carry power from pins 7 and 8 to the high-voltage power strip 502 and then on to pins 7 and 8 of the first side 704 of the second connector 702.

Wires 804 conduct low-voltage signals between pins 1 and 2 and receptacle 810 in the strip 508. Wires 804 also conduct low-voltage signals from pins 1 and 2 of the first connector to pins 1 and 2 of the first side 704 of the second connector 702. Because pins 1 and 2 are connected to the receptacle 810 and to the second connector 702, it is possible for devices on the second platform 606 to communicate with devices on the first platform 604 and vice versa.

A third set of wires 806 conduct low-voltage signals between pins 3 and 4 and a second data receptacle 812 in the low-voltage strip 508. Wires 806 also conduct low-voltage signals from pins 3 and 4 of the first connector to pins 3 and 4 of the first side 704 of the second connector 702. Because pins 3 and 4 are connected to the data receptacle 812 and to the second connector 702, it is possible for devices on the second platform 606 to communicate with devices on the first platform 604 and vice versa.

A fourth set of wires 808 directly connect pins 5 and 6 of the first connector to pins 5 and 6 of the second connector 702. Wires 808 can be used to communicate data directly and exclusively between the two connectors 302 and 702. As stated above and shown in FIG. 2, outside devices can attach to the base 102 through ports 212. Through use of wires 808, a device on the second platform 606 can communicate directly with outside devices via cables 204 and data communication ports 212.

In addition, a low-voltage data connector 814 is connected directly to another low-voltage data connector 816 through wires 818. Through these connectors, two electronic items on the same platform can be communicatively coupled together via that platform's column. Any number of connectors can be coupled together on the same platform. Connection through the column allows the electronic items to be added and removed easily without having to physically connect the items to each other.

Also shown in FIG. 8, the first platform 604 is mechanically coupled to the second side 306 of the first connector 302. The second platform 606 is mechanically coupled to the second side 706 of the second connector 702. When the first and second platforms 604 and 606 rotate in relation to each other, the pins 1-8 on the first side 304 of the first connector 302 remain continuously electrically coupled to pins 1-8 on the second side 706 of the second connector 702 as shown in the wiring diagram of FIG. 8. These pins remain connected regardless of rotational movement of the two sides of either connector.

Referring once again to FIG. 6, a third platform 608, which includes a third platform 618 is placed on top of the second column 616 of the second platform 606. The third platform 618 can be fixedly attached to the second column 616, so that the third platform 618 moves in unison with the second column 616 or, in an alternative embodiment, a third rotatable connector 624, which is similar in structure to the first and second connectors 302 and 702, couples the third platform 618 to the second column 616 so that the third platform 618 can rotate independently of the second column 616 below. In one embodiment of the present invention, a printer port is provided in the center of the third platform 618 so that a printer can rest on the third platform and receive data from a computer stored on the first or second platforms 610, 614.

Figure 9:
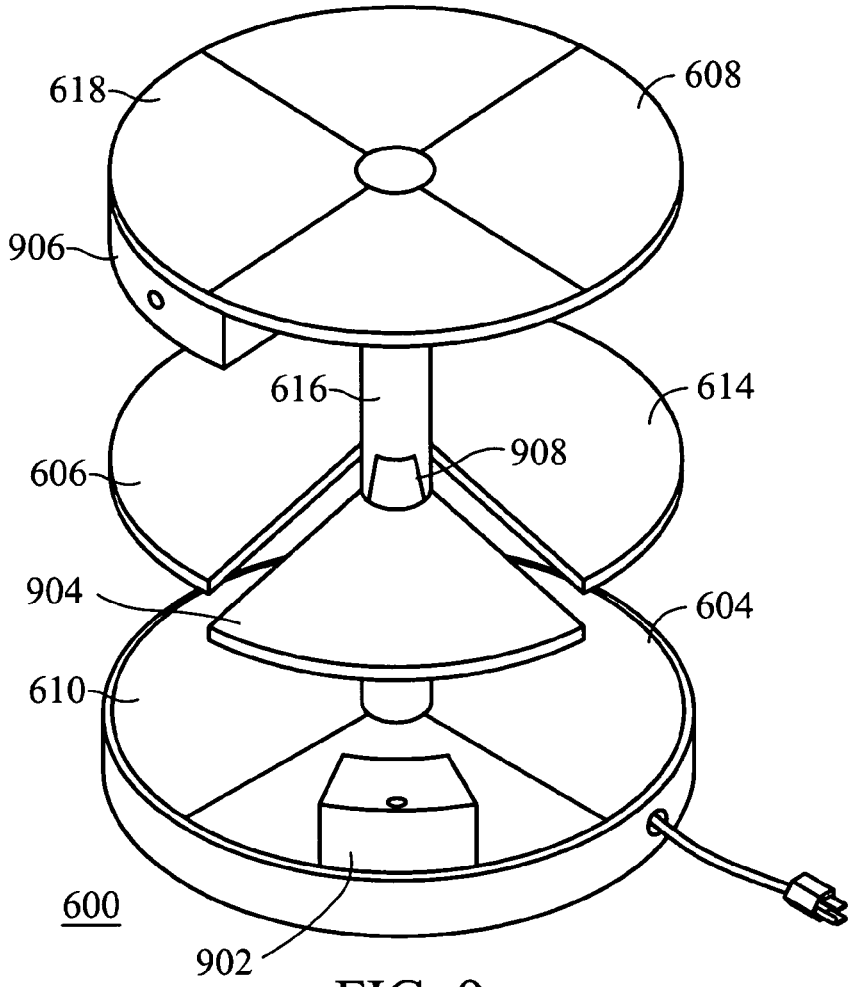
FIG. 9 is a perspective view of a further assembly of the present invention.

Referring now to FIG. 9, the platforms 610, 614, 618 of the assembly 600 can include one or more storage containers 902. The storage container 902 can be a reach-in container, or, in an alternative embodiment, can be a drawer-type container 906 attached to a bottom surface of the platforms.

The surfaces of the platforms 604, 606, 608 can be divided into individual sections or portions. One or more of the portions can be an extendable section 904 so that an item supported by the extendable section 904 can translated in and out from a center point of the assembly 600.

The extendable section 904 can be connected to a track assembly 908, where a fixed portion of the track assembly 908 is connected to a column 612 or 616. The track assembly 908 includes an extendable portion, affixed to the extendable section 904, which can be translated through or along the fixed portion, allowing the extendable section 904 to be translated with respect to the column 612 or 616. The extendable section 904 allows easier access to an electronic item resting on the extendable section 904. The invention is not limited to track assembly 908 and can include any mechanism that will allow the portions to be dislocated relative to the center column.

In the alternative, the platforms 610, 614, 618 can be divided into individual sections or portions. One or more of the section can be removably attachable to the column 612 or 616 and an adjacent portion of the platform. The removable section permits the placement of tall devices, such as a tower CPU in the assembly.

Figure 10:
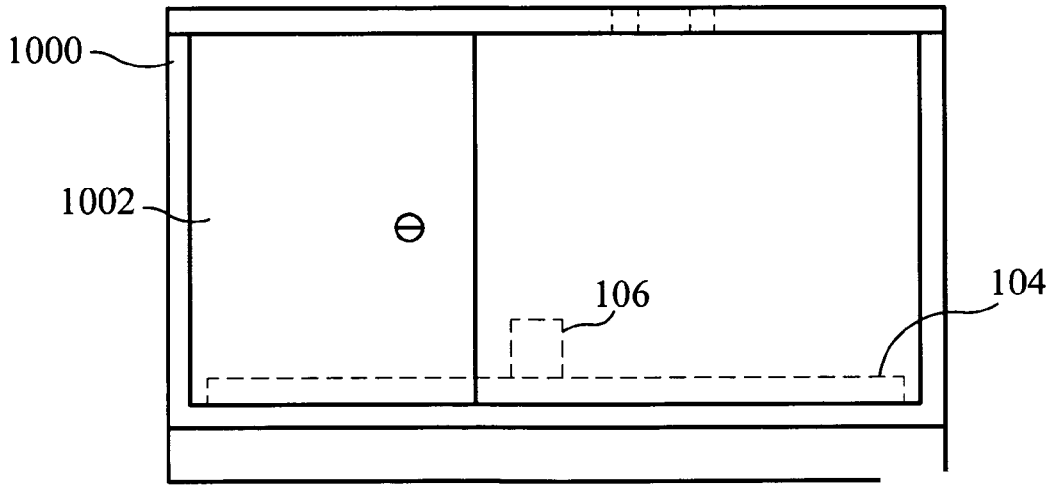
FIG. 10 depicts a cabinet of the assembly of the present invention.

Referring to FIG. 10, the assembly 100 or 600 of the present invention can be enclosed with a cabinet 1000. The cabinet 1000 includes a door 1002 which permits access to the stored devices. The door 1002 can be hinged, a sliding pocket door, or otherwise and can be opened to access the contents behind the door 1002.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A device for supporting and providing user access to a plurality of items, the device comprising:

a base member including high and low voltage base connectors;

a support platform rotatably positioned on the base member and including an acceptor assembly having high and low voltage receptacles;

a rotatable connector having a first connector portion and a second connector portion rotatable with respect to the first connector portion, the first and second connector portions each including high and low voltage connectors, wherein the rotatable connector electrically couples the acceptor assembly high and low voltage receptacles and the high and low voltage base connectors, such that the acceptor assembly high and low voltage receptacles are rotatable with respect to the high and low voltage base connectors as the support platform is rotated with respect to the base member.

2. The device as set forth in claim 1 wherein the high and low voltage connectors of the first connector portion are electrically coupled to the acceptor assembly high and low voltage receptacles and the high and low voltage connectors of the second connector portion are electrically coupled to the high and low voltage base connectors.

3. The device as set forth in claim 1 further comprising a second support platform operably connected to the support platform.

4. The device as set forth in claim 3 wherein the second support platform comprises a second acceptor assembly having high and low voltage receptacles.

5. The device as set forth in claim 4 wherein the acceptor assembly is a first column having a first end affixed to the support platform and a second end affixed to the second support platform.

6. The device as set forth in claim 5 wherein the second end of the first column is rotatably connected to the second support platform, such that the second support platform is rotatable with respect the support platform.

7. The device as set forth in claim 4 further comprising a second rotatable connector having a first connector portion and a second connector portion rotatable with respect to the first connector portion, the first and second connector portions each including high and low voltage connectors.

8. The device as set forth in claim 7 wherein the second rotatable connector electrically couples the second acceptor assembly high and low voltage receptacles and the acceptor assembly first connector portion high and low voltage connectors, such that the second acceptor assembly high and low voltage connectors are rotatable with respect to the acceptor assembly first connector portion high and low voltage connectors as the second support platform is rotated with respect to the support platform.

9. The device as set forth in claim 3 wherein the second support platform comprises a plurality of sections.

10. The device as set forth in claim 9 wherein at least one of the plurality of sections is extendable.

11. The device as set forth in claim 3 wherein the second support platform includes a storage container.

12. The device as set forth in claim 1 wherein the support platform comprise a plurality of sections.

13. The device as set forth in claim 1 wherein at least one of the plurality of sections is extendable.

14. The device as set forth in claim 1 wherein the acceptor assembly comprises a pair of interconnected low-voltage receptacles.

15. The device as set forth in claim 1 where the base member further comprises a surge protector connected to the high and low voltage base connectors.

16. The device as set forth in claim 1 where the base member further comprises an uninterrupted power supply connected to the high voltage base connector.

17. The device as set forth in claim 1 wherein the low voltage connectors of the base member and the low voltage receptacles acceptor assembly is selected from the group consisting of an Ethernet port, a phone jack, a USB port, a serial port, a parallel port, a coaxial cable connector, an RCA jack, or combinations thereof.

18. A device for supporting and providing user access to a plurality of items comprising:

a base including high and low voltage connectors;

a first support platform rotatably positioned on the base;

a first column affixed to and extending from the first support platform;

a second support platform rotatable affixed to the first column, such that the second support platform is rotatable with respect to first support platform;

a second column affixed to and extending from the second supporting platform;

a high-voltage receptacle provided in each of the first and second columns;

a low-voltage receptacle provided in each of the first and second columns;

a first rotatable connector operably connecting the high and low voltage receptacles of the first column to the base high and low voltage connectors; and a second rotatable connector operably connecting the high and low voltage receptacles of the second column to the high and low voltage receptacles of the first column.

* * * * *